US005775685A

United States Patent [19]

Yamaoka et al.

[11] Patent Number: 5,775,685

[45] Date of Patent: Jul. 7, 1998

[54] SHEET MEMBER CONVEYING MECHANISM

[75] Inventors: Masanori Yamaoka; Keiji Ban; Hiroshi Kobayashi, all of Osaka, Japan

[73] Assignee: Mita Industrial Co., Ltd., Osaka, Japan

[21] Appl. No.: 686,537

[22] Filed: Jul. 26, 1996

[30] Foreign Application Priority Data

| | | | |
|---|---|---|---|
| Aug. 2, 1995 | [JP] | Japan | 7-218128 |
| Aug. 2, 1995 | [JP] | Japan | 7-218132 |
| Aug. 2, 1995 | [JP] | Japan | 7-218134 |

[51] Int. Cl.[6] ..... B65H 5/00

[52] U.S. Cl. ..... 271/10.13; 271/10.11; 271/109; 271/270; 271/272

[58] Field of Search ..... 271/3.18, 4.1, 271/4.08, 10.09, 10.11, 10.13, 109, 116, 272, 314, 270

[56] References Cited

U.S. PATENT DOCUMENTS

| | | | |
|---|---|---|---|
| 4,696,462 | 9/1987 | Tanaka et al. | 271/10.11 |
| 4,872,661 | 10/1989 | Knepper | 271/314 |
| 4,927,130 | 5/1990 | Tanaka et al. | 271/10.11 |
| 5,161,794 | 11/1992 | Adachi | 271/272 |
| 5,169,136 | 12/1992 | Yamagata et al. | 271/272 |
| 5,240,239 | 8/1993 | Kim | 271/10.11 |
| 5,474,287 | 12/1995 | Takahashi | 271/10.11 |
| 5,533,822 | 7/1996 | Tsukada et al. | 271/109 |

FOREIGN PATENT DOCUMENTS

| | | | |
|---|---|---|---|
| 405139566 A | 6/1993 | Japan | 271/109 |
| 406156767 A | 6/1994 | Japan | 271/109 |

*Primary Examiner*—H. Grant Skaggs

*Attorney, Agent, or Firm*—Antonelli, Terry, Stout, & Kraus, LLP

[57] ABSTRACT

A sheet member conveying mechanism, including a conveying guide for guiding a sheet member from a paper feed port to a paper discharge tray, a forwarding roller disposed on the most upstream side of the conveying guide, and a paper feed roller disposed on the downstream side of the forwarding roller to convey sheet members, forwarded by the forwarding roller, downstream one by one. An upper part of the outer peripheral surfaces of each of the forwarding roller and the paper feed roller is exposed above the upper surface of the conveying guide. The uppermost site of the paper feed roller is located at a lower position than the uppermost site of the forwarding roller. In order to avoid contact with a curled front end portion of a sheet member positioned on the forwarding roller, the upper surface of the conveying guide is curved such that its height decreases, beginning at the downstream end of the exposed part of the outer peripheral surface of the forwarding roller toward the upstream end of the exposed part of the outer peripheral surface of the paper feed roller, as viewed in the axial direction.

15 Claims, 9 Drawing Sheets

SHEET MEMBER CONVEYING MECHANISM

FIELD OF THE INVENTION

This invention relates to a sheet member conveying mechanism to be applied to an image forming machine such as an electrostatic facsimile, an electrostatic copying machine or an electrostatic printing machine.

DESCRIPTION OF THE PRIOR ART

An example of a conventional sheet member conveying mechanism is a sheet member conveying mechanism which is applied to an electrostatic facsimile machine. A typical example of this sheet member conveying mechanism comprises a lower conveying guide for guiding a document from a paper feed port to a paper discharge tray, a forwarding roller disposed on the most upstream side of the lower conveying guide, a paper feed roller disposed on the downstream side of the forwarding roller to convey documents, sent forward by the forwarding roller, downstream one by one, a conveying roller pair disposed on the downstream side of the paper feed roller, and a discharge roller pair disposed on the downstream side of the conveying roller pair. An image reader is disposed between the conveying roller pair and the discharge roller pair. Above the lower conveying guide is disposed an upper conveying guide.

Above the forwarding roller is disposed a pressing plate. An end of the pressing plate is supported pivotably, and a lower surface of the other end thereof is pressed by a spring against the forwarding roller. Above the paper feed roller is disposed a separation pad, whose lower surface is pressed against the paper feed roller.

A document in the form of a sheet member is inserted through the paper feed port. When it is detected by a document setting switch, the forwarding roller is turned about one turn by the action of a driving system including an electric motor. As a result, the document is automatically pinched between the forwarding roller and the pressing plate, and positioned thereby. When a transmission button is depressed, the discharge roller pair, conveying roller pair, paper feed roller and forwarding roller are rotationally driven. The document is carried along the lower conveying guide and discharged onto the paper discharge tray. During this motion, the image of the document is optically read by an image reader.

The peripheral speeds of the rollers are set such that the peripheral speed of the paper feed roller is higher than that of the forwarding roller, the peripheral speed of the conveying roller pair is higher than that of the paper feed roller, and the peripheral speed of the conveying roller pair is equal to that of the discharge roller pair. One-way clutches are disposed for the paper feed roller and the forwarding roller. Thus, when the document begins to be conveyed by the conveying roller pair, the one-way clutches of the paper feed roller and the forwarding roller work, so that a driving force is not transmitted to these rollers any longer. The paper feed roller and the forwarding roller freewheel via the document simultaneously with the rotation of the conveying roller pair. Once the rear end of the document leaves the forwarding roller, the one-way clutches no longer act, and a driving force becomes transmissible again with a slight time lag (the paper feed roller undergoes a similar action). This action prevents a next document from being fed during delivery of the preceding document to cause an overlap of the documents.

Next, an explanation will be offered for some problems with the above-described conventional sheet member conveying mechanism.

(1) A document (paper) inserted through the paper feed port often curls up at the front end. Such a curled document is frequently observed among documents copied by an electrostatic copying machine. If a document which is pinched between the forwarding roller and the pressing plate for positioning has a curled part with a relatively high stiffness (so-called nerve), the front end of the document contacts the upper surface of the conveying guide on the downstream side of the forwarding roller. The curled part is situated arcuately with a gap present upward of the forwarding roller, with the result that the document does not keep satisfactory contact with the forwarding roller. Thus, even upon the rotational driving of the forwarding roller, the document is often not carried.

To resolve the above disadvantage, the spring of the pressing plate may be made too strong. However, this is prone to leave traces of the forwarding roller on the document. If the document is relatively thin, such a high spring force may cause a great resistance to the delivery of the document, making satisfactory forward movement of the document impossible.

(2) The conveying roller pair is composed of a lower conveying roller to be rotationally driven by the driving system, and an upper conveying roller to be caused to follow the lower conveying roller. The lower conveying roller is mounted integrally rotatably on a metallic shaft member. This shaft member is rotatably supported via flanged bearing members between a pair of upright walls arranged with a spacing. Each of the bearing members is inhibited from axial movement by a stop ring mounted on the shaft member. An end of the shaft member extends outwardly from one of the upright walls, and a driven gear is mounted on this extension. This driven gear is also kept from axial movement by a pair of stop rings mounted on the shaft member. To the metallic shaft member is coupled a grounded member for antistatic purposes. The lower conveying roller, which is a roller member, the shaft member, the driven gear, and the two stop rings for the driven gear constitute a roller assembly. As will be easily understood from this constitution, the roller assembly poses the problems of having many constituent parts, requiring a tiresome assembly operation, having a large weight, and having a high cost. Owing to that constitution of the roller assembly, moreover, the two bearing members and the two stop rings are used to rotatably support the roller assembly. Thus, the rotation support mechanism for the roller assembly also involves the problems of having many constituent parts and requiring a tiresome assembly operation.

The discharge roller pair is composed of a lower discharge roller to be rotationally driven by the driving system, and an upper discharge roller to be caused to follow the lower discharge roller. The lower discharge roller, which is a roller member, is also included in a roller assembly having substantially the same constitution as described above. Thus, this roller assembly faces the same problems as those of the above-mentioned roller assembly.

(3) The paper feed roller (roller member) is rotatably supported on a metallic shaft member. This shaft member is rotatably supported via bearing members between a pair of upright walls arranged with a spacing. Between the shaft member and the paper feed roller is provided a one-way clutch comprising a driving cam and a driven cam. The driven cam is connected to the paper feed roller side. On the shaft member are mounted a driving cam, a spring, a stop ring for the spring, and a driven gear to be drivingly connected to a drive source. In order for the driving cam, the stop ring for the spring, and the driven gear to be connected together to the shaft member so as to be rotatable integrally therewith, a flat cutout is formed in the shaft member (hence, the shaft member has a D-shaped cross section). A similar D-shaped hole is formed in each of the corresponding members described above (only the driving cam is axially movable). The spring is disposed between the stop ring for the spring and the driving cam to urge the driving cam axially so as to engage the driven cam. The driven gear is also kept from axial movement by a pair of stop rings mounted on the shaft member. The paper feed roller, the shaft member, the one-way clutch comprising the driving cam and the driven cam, the spring, the stop ring for the spring, the driven gear, and two stop rings for the driven gear constitute a roller assembly. As will be easily understood from this constitution, the roller assembly including the one-way clutch poses the problems of requiring a tiresome processing operation, having many constituent parts, requiring tiresome assembly operation, having a large weight, and having a high cost.

The forwarding roller, which is a roller member, is also included in a roller assembly having substantially the same constitution as described above. Thus, this roller assembly faces the same problems as those of the above-mentioned roller assembly.

SUMMARY OF THE INVENTION

A first object of the present invention is to provide an improved sheet member conveying mechanism which can reliably convey a sheet member even with a curled front end portion.

A second object of the present invention is to provide an improved sheet member conveying mechanism having a roller assembly which uses fewer constituent parts, is easy to assemble, is lightweight, and can be produced at a low cost.

A third object of the present invention is to provide an improved sheet member conveying mechanism having a roller assembly including a one-way clutch, which is easy to produce, uses fewer constituent parts, is easy to assemble, is lightweight, and requires a low cost.

According to a first aspect of the present invention, there is provided a sheet member conveying mechanism comprising a conveying guide for guiding a sheet member from a paper feed port to a paper discharge tray, a forwarding roller disposed on the most upstream side of the conveying guide such that an upper part of the outer peripheral surface of the forwarding roller is exposed upwards from the upper surface of the conveying guide over a predetermined peripheral range, and a paper feed roller disposed on the downstream side of the forwarding roller such that an upper part of the outer peripheral surface of the paper feed roller is exposed upwards from the upper surface of the conveying guide over a predetermined peripheral range, whereby sheet members, sent forward by the forwarding roller, are conveyed downstream one by one; the axes of the forwarding roller and the paper feed roller being located parallel to each other, and the uppermost site of the paper feed roller being located lower than the uppermost site of the forwarding roller; wherein in order to avoid contact with a curled front end portion of a sheet member positioned on the forwarding roller, the upper surface of the conveying guide is curved such that its height decreases, beginning at the downstream end of the exposed part of the outer peripheral surface of the forwarding roller toward the upstream end of the exposed part of the outer peripheral surface of the paper feed roller, as viewed in the direction of the axes.

In this aspect of the invention, even when the curled front end portion of the sheet member inserted through the paper feed port and positioned on the forwarding roller has a relatively high stiffness, the upper surface of the conveying guide is curved, as viewed in the axial direction, such that its height decreases, beginning at the downstream end of the exposed part of the outer peripheral surface of the forwarding roller toward the upstream end of the exposed part of the outer peripheral surface of the paper feed roller, in order to avoid contact with the front end portion. Thus, the contact of the front end of the sheet member with the upper surface of the conveying guide can be avoided without fail. Since the sheet member is positioned in intimate contact with the forwarding roller, the sheet member is advanced reliably, when the forwarding roller is rotationally driven. That is, the above-described aspect of the invention attains the first object.

According to a second aspect of the present invention, there is provided a sheet member conveying mechanism comprising a conveying guide for guiding a sheet member from a paper feed port to a paper discharge tray, a forwarding roller disposed on the most upstream side of the conveying guide such that an upper part of the outer peripheral surface of the forwarding roller is exposed upwards from the upper surface of the conveying guide over a predetermined peripheral range, and a paper feed roller disposed on the downstream side of the forwarding roller such that an upper part of the outer peripheral surface of the paper feed roller is exposed upwards from the upper surface of the conveying guide over a predetermined peripheral range, whereby sheet members, sent forward by the forwarding roller, are conveyed downstream one by one; the axes of the forwarding roller and the paper feed roller being located parallel to each other, and the uppermost site of the paper feed roller being located lower than the uppermost site of the forwarding roller; wherein when the curvature of the outer peripheral surface of the forwarding roller is expressed by the radius, R, of the forwarding roller, and when the peripheral angle from the uppermost site of the outer peripheral surface of the forwarding roller to the downstream end of the exposed part of the outer peripheral surface of the forwarding roller, as viewed in the axial direction, is expressed as θ, $$12\ \text{mm} > R > 8\ \text{mm}$$

$$80^\circ > \theta > 60^\circ$$

when the vertical distance from the uppermost site of the forwarding roller to the uppermost site of the paper feed roller is expressed as h, $$10\ mm > h > 6\ mm$$

and as viewed in the axial direction, the upper surface of the conveying guide is formed so as to have no upwardly displaced part between the downstream end of the exposed part of the forwarding roller and the upstream end of the exposed part of the paper feed roller.

In this aspect of the invention, the range of exposure of the outer peripheral surface of the forwarding roller from the upper surface of the conveying guide, and the range of downward positioning of the paper feed roller with respect to the forwarding roller are defined as described above. Furthermore, the upper surface of the conveying guide, ranging from the downstream end of the exposed part of the outer peripheral surface of the forwarding roller to the upstream end of the exposed part of the outer peripheral surface of the paper feed roller, is formed so as to have no upwardly displaced part. Thus, this aspect of the invention achieves substantially the same actions and effects as those of the first aspect of the invention.

According to a third aspect of the present invention, there is provided a sheet member conveying mechanism comprising a pair of upright walls arranged with a spacing, and a roller assembly rotatably supported between the upright walls, wherein one of the upright walls is provided with a support hole, the roller assembly includes a shaft member of a plastic material, a roller member of synthetic rubber mounted on the shaft member, and an input gear member of a plastic material having an integrally molded journal portion having a connecting hole, the journal portion being releasably and rotatably supported in the support hole, and one end portion of the shaft member is releasably inserted into the connecting hole of the input gear member, whereby the shaft member and the input gear member are coupled together so as to rotate integrally.

In this aspect of the invention, the roller assembly is composed of the shaft member, the roller member, and the input gear member, and uses no metallic materials. The roller assembly is assembled by inserting the journal portion of the input gear member into the support hole of one of the upright walls, and simultaneously inserting the shaft member mounted with the roller member into the connecting hole of the journal portion. Thus, this roller assembly has fewer constituent parts, and is easy to assemble, lightweight, and producible at a low cost. That is, this aspect of the invention attains the second object. Besides, the journal portion of the input gear member also functions as a bearing on one end portion side of the shaft member. This eliminates the need for a bearing and a stop ring used so far on the same portion. With the rotation support mechanism of the roller assembly, therefore, the number of constituent parts becomes small, making an assembly operation easy.

According to a fourth aspect of the present invention, there is provided a sheet member conveying mechanism comprising a first roller assembly having a relatively high peripheral speed, a second roller assembly disposed upstream of the first roller assembly and having a relatively low peripheral speed, and a pair of upright walls arranged with a spacing; in which the second roller assembly comprises a shaft member rotatably supported between the upright walls, and a roller member rotatably supported on the shaft member; a one-way clutch including a driving cam and a driven cam is provided between the shaft member and the roller member; the roller member is provided with the driven cam so that the driven cam can rotate integrally with the roller member; the shaft member is provided with the driving cam and a driven gear to be drivingly coupled to a drive source so that the driving cam and the driven gear can rotate integrally with the shaft member, and the shaft member has an urging means disposed thereon to urge the driving cam axially into engagement with the driven cam; with the driven gear being rotationally driven by the drive source, when the rotational speed of the roller member does not exceed the rotational speed of the driven gear, the driven cam is engaged with the driving cam, whereby the roller member is rotationally driven by the driven gear; when the rotational speed of the roller member exceeds the rotational speed of the driven gear, the driven cam is disengaged from the driving cam; wherein the shaft member is rotatably and axially movably supported via bearing members of a plastic material between the upright walls, the roller member is formed of synthetic rubber, and is mounted on a collar means rotatably supported on the shaft member so as to be rotatable integrally with the collar means, the collar means and the driven cam being integrally molded from a plastic material, and the shaft member, the driving cam and the driven gear are integrally molded from a plastic material.

In this aspect of the invention, the roller assembly uses no metallic material. The shaft member, the driving cam and the driven gear are integrally molded from a plastic material, and so constituted from one constituent part. This makes it unnecessary to process the shaft member and the support holes of the respective members fitted to it to be D-shaped as in the prior art. Consequently, the roller assembly is easy to produce, lower in the number of constituent parts, simple in assembly operation, lightweight, and low in the cost of production. That is, this aspect of the invention attains the third object.

Other objects and features of the present invention will become apparent from the following detailed description of embodiments of a sheet member conveying mechanism constructed in accordance with the present invention, considered in conjunction with the appended drawings.

DETAILED DESCRIPTION OF THE PREFERRED EMBODIMENTS

A sheet member conveying mechanism constructed in accordance with the present invention will be described in detail as an embodiment applied to an electrostatic facsimile, by reference to the appended drawings.

Figure 1:
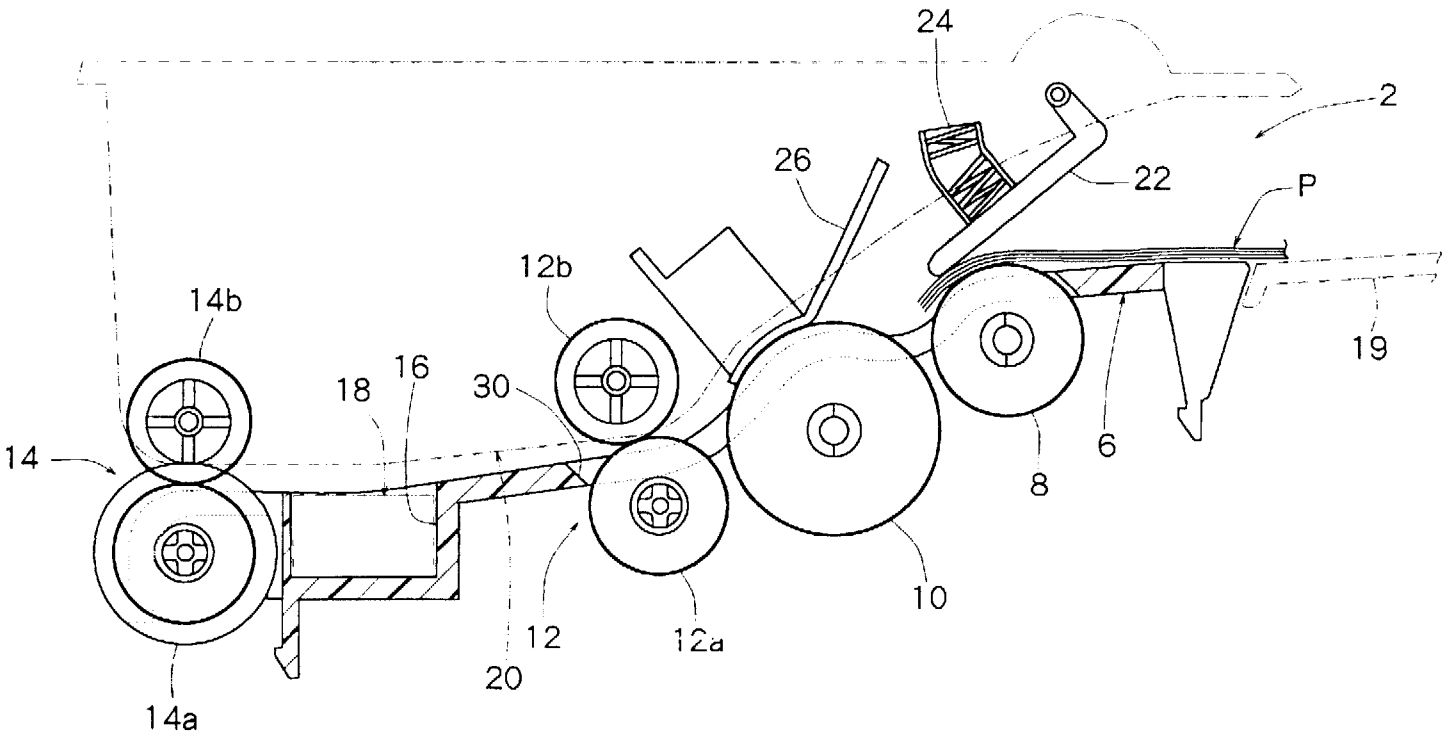
FIG. 1 is a partially sectional side view schematically showing an embodiment of a sheet member conveying mechanism constructed in accordance with the present invention.

With reference to FIG. 1, a sheet member conveying mechanism comprises a lower conveying guide 6 (constituting a conveying guide) for guiding a document (generally, paper) as a sheet member, whose undersurface bears an image, from a paper feed port 2 to a paper discharge tray 4 (see FIG. 5), a forwarding roller 8 disposed on the most upstream side of the lower conveying guide 6, a paper feed roller 10 disposed on the downstream side of the forwarding roller 8 to convey documents, sent forward by the forwarding roller 8, downstream one by one, a conveying roller pair 12 disposed on the downstream side of the paper feed roller 10, and a discharge roller pair 14 disposed on the downstream side of the conveying roller pair 12. At a site of the lower conveying guide 6 between the conveying roller pair 12 and the discharge roller pair 14, a depression 16 is formed so as to extend in a width direction (the face-and-back direction of FIG. 1), and an image reader 18 is disposed in the depression 16. Upstream of the lower conveying guide 6 is disposed a document placing table 19. Above the lower conveying guide 6 is disposed an upper conveying guide 20. The direction of paper passage is right-and-left in FIG. 1.

Above the forwarding roller 8 is disposed a pressing plate 22. An upper end of the pressing plate 22 is pivotably supported on the upper conveying guide 20, and a lower surface of the other end of the pressing plate 22 is pressed by a spring 24 against the forwarding roller 8. Above the paper feed roller 10 is disposed a separation pad 26 whose lower surface is pressed against the paper feed roller 10.

The axes of the forwarding roller 8, the paper feed roller 10, the conveying roller pair 12, and the discharge roller pair 14 are arranged parallel. The conveying roller pair 12 consists of a lower conveying roller **12*a* and an upper conveying roller 12*b*, while the discharge roller pair 14 consists of a lower discharge roller 14*a* and an upper discharge roller 14*b*. The axial length (the length in the face-to-back direction in FIG. 1) of the paper feed roller 10 is set to be equal to that of the lower conveying roller 12*a*. That of the forwarding roller 8 is set to be smaller than that of the paper feed roller 10 and the lower conveying roller 12*a*, while that of the lower discharge roller 14*a* is set to be larger than that of the paper feed roller 10 and the lower conveying roller 12*a***.

Figure 3:
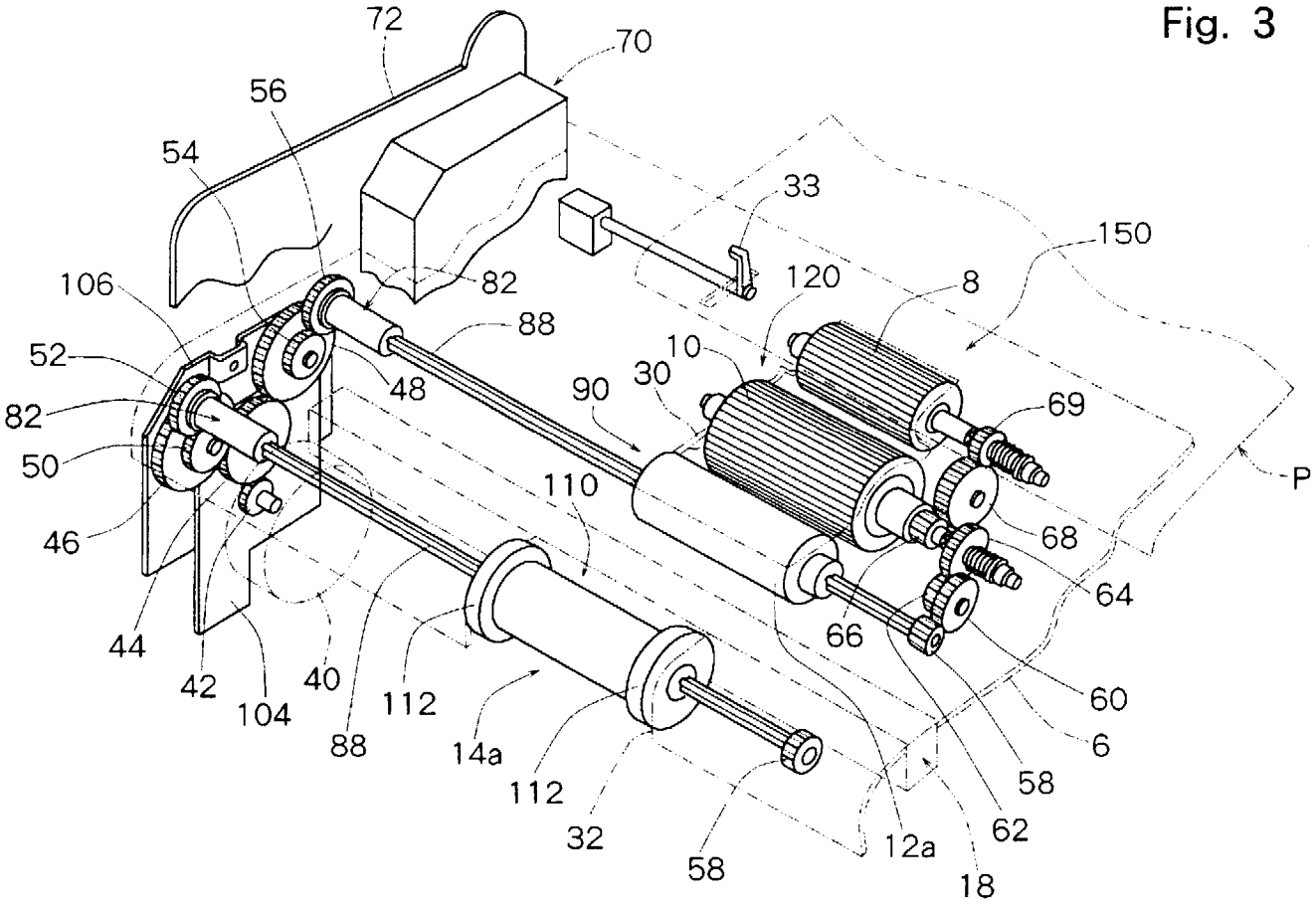
FIG. 3 is a perspective schematic view of the sheet member conveying mechanism shown in FIG. 1.

With reference to FIG. 3 along with FIG. 1, an opening 30 is formed in the lower conveying guide 6. The upstream edge of the opening 30 extends axially parallel to the outer peripheral surface of the forwarding roller 8 on the upstream side of the top of the forwarding roller 8. The downstream edge of the opening 30 extends axially along the outer peripheral surface of the lower conveying roller **12*a* on the downstream side of the top of the lower conveying roller 12*a*. The opposite side edges of the opening 30 comprise first parts extending parallel and downstream from the upstream edge along the upper parts of the opposite sides of the forwarding roller 8, second parts extending from the downstream ends of the first parts axially away from each other, and third parts extending parallel and downstream from the opposite ends of the second parts along the upper parts of the opposite sides of the paper feed roller 10 and the lower conveying roller 12*a*. In other words, the forwarding roller 8, the paper feed roller 10 and the lower conveying roller 12*a* are disposed such that an upper part of the outer peripheral surface of each of them is exposed upwards from the upper surface of the lower conveying guide 6 through the opening 30 over a predetermined peripheral range. The uppermost site of the paper feed roller 10 is positioned to be lower than the uppermost site of the forwarding roller 8**.

A cutout 32 is formed in the downstream end of the lower conveying guide 6. The lower discharge roller **14*a* is disposed such that an upper part of its outer peripheral surface is exposed upwards from the upper surface of the lower conveying guide 6 through the cutout 32 over a predetermined peripheral range. Each of the above-described rollers is located nearly at the widthwise center of the lower conveying guide 6. The width of the lower discharge roller 14*a*, being the largest width of the above rollers, is set to be smaller than the width of a document having the smallest width of documents to be conveyed by these rollers. The shape of the upper surface of the lower conveying guide 6, when viewed as a section in the direction of paper passage, is set to be substantially constant at least in the range of the width of a document having the largest width (the range where the document makes contact with the lower conveying guide 6). In FIG. 3, the numeral 33** denotes a document setting switch.

Figure 2:
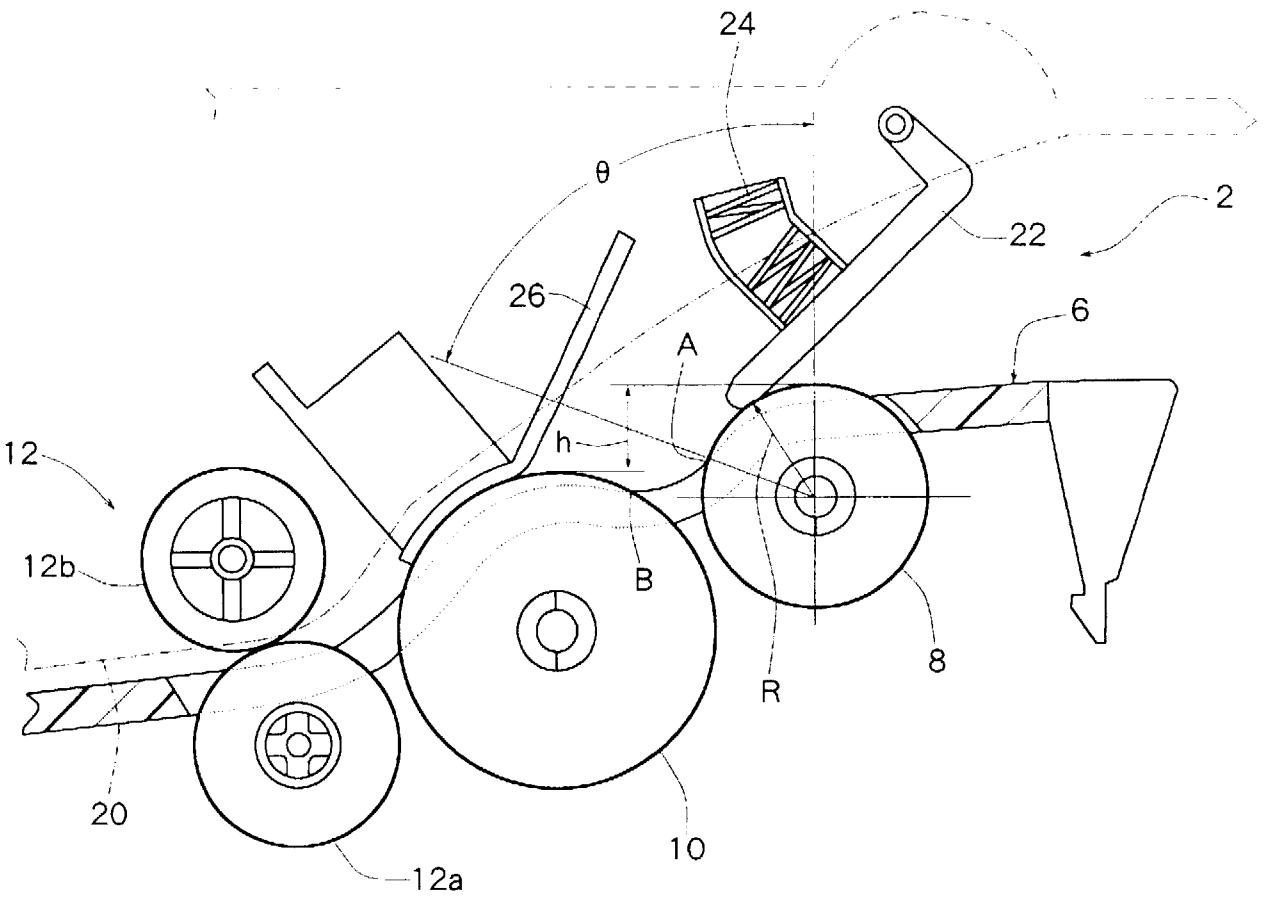
FIG. 2 is a enlarged partial view of FIG. 1.

With reference to FIG. 2, in order to avoid contact with a curled front end portion of a document positioned on the forwarding roller 8, the upper surface of the lower conveying guide 6 is curved such that when viewed in the axial direction, its height decreases, beginning at the downstream end A of the exposed part of the outer peripheral surface of the forwarding roller 8 toward the upstream end B of the exposed part of the outer peripheral surface of the paper feed roller 10. The upper surface of the lower conveying guide 6 is formed so as to have no upwardly displaced part between the above downstream end A of the exposed part and the upstream end B of the exposed part. When viewed from the axial direction, the downstream end A of the exposed part of the forwarding roller 8 is shown as a point where a site downstream of the uppermost site of the outer peripheral surface of the forwarding roller 8 intersects the upper surface of the lower conveying guide 6. When viewed from the axial direction, the upstream end B of the exposed part of the paper feed roller 10 is shown as a point where a site upstream of the uppermost site of the outer peripheral surface of the paper feed roller 10 intersects the upper surface of the lower conveying guide 6.

Immediately downstream of the forwarding roller 8, there is a space formed by the opening 30, and the lower conveying guide 6 is not present. Thus, one will easily understand that the region where the points A and B exist is the upper surface of the lower conveying guide 6 extending on the opposite sides of the opening 30. When the lower conveying guide 6 is viewed from above, the points A and B will be indicated as lines A and B (not shown).

When the curvature of the outer peripheral surface of the forwarding roller 8 is expressed by the radius, R, of the forwarding roller 8; when the peripheral angle from the uppermost site of the outer peripheral surface of the forwarding roller 8 to the downstream end A of the exposed part of the outer peripheral surface of the forwarding roller 8, as viewed in the axial direction, is expressed as θ; and when the vertical distance from the uppermost site of the forwarding roller 8 to the uppermost site of the paper feed roller 10 is expressed as h, it is important that the following relationships hold $$12\ mm > R > 8\ mm$$

$80° > \theta > 60°$ $10\ mm > h > 6\ mm.$

In the illustrated embodiment, the radius R, the angle θ, and the distance h are set, respectively, as follows: R=10 mm, θ=72°, and h=8 mm. The upper surface of the lower conveying guide 6 between the points A and B is formed to define a smooth curve. There holds an embodiment in which the upper surface of the lower conveying guide 6 between the points A and B is formed to define a downward straight line. Because of this constitution, even if the front end of a document contacts the upper surface of the lower conveying guide 6, the document can be guided smoothly, and a jam can be prevented reliably.

As shown in FIG. 1, even when a curled front end portion of a document, P, inserted through the paper feed port 2 and positioned on the forwarding roller 8 has a relatively high stiffness, the upper surface of the lower conveying guide 6 is curved, as viewed in the axial direction, such that its height decreases, beginning at the downstream end A of the exposed part of the outer peripheral surface of the forwarding roller 8 toward the upstream end B of the exposed part of the outer peripheral surface of the paper feed roller 10, in order to avoid contact with the front end portion. Thus, the contact of the document P with the upper surface of the lower conveying guide 6 can be avoided without fail. That curved portion has a downwardly protruding shape between the forwarding roller 8 and the paper feed roller 10, as shown in FIG. 1 and FIG. 2. Since the document P is positioned in intimate contact with the forwarding roller 8, the document P is advanced reliably when the forwarding roller 8 is rotationally driven. This action and effect can be achieved securely, because the radius R, the angle θ, and the distance h are set as described above, and the upper surface of the lower conveying guide 6 is formed so as to have no upwardly displaced part between the downstream end A of the exposed part and the upstream end B of the exposed part.

Figure 5:
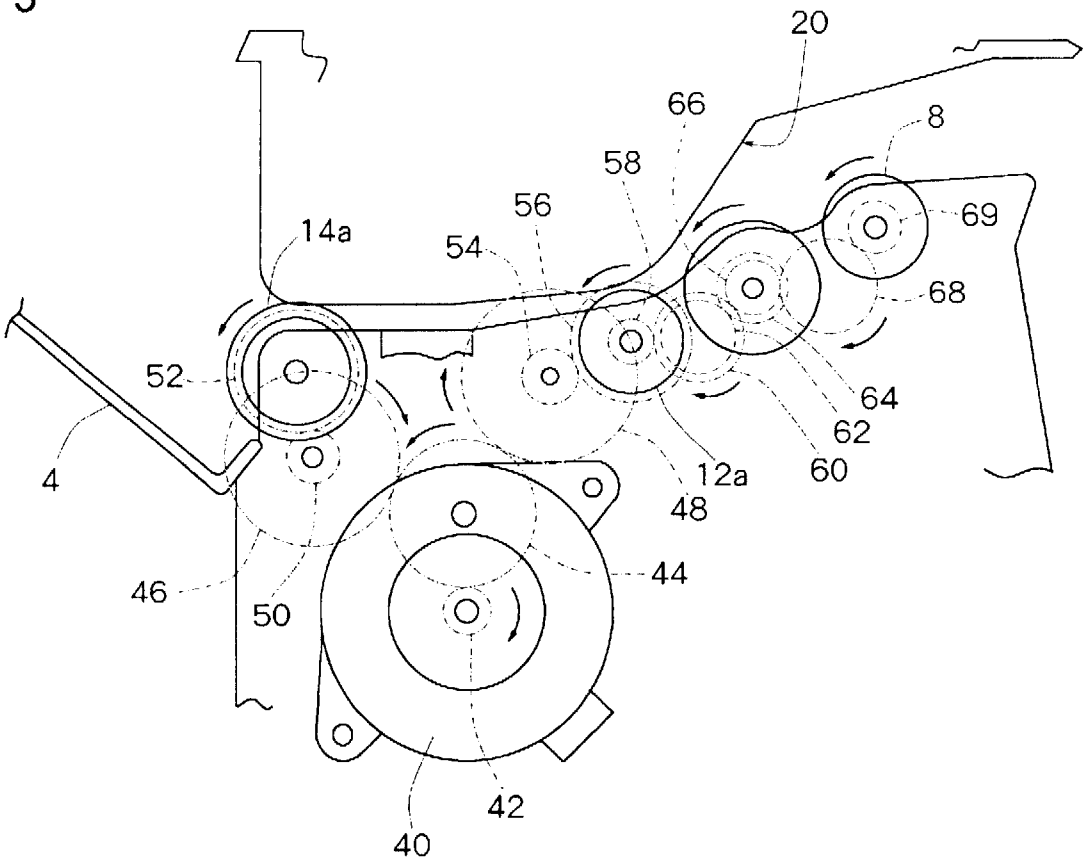
FIG. 5 is a side view schematically showing the driving system illustrated in FIG. 3.

With reference to FIG. 3 and FIG. 5, a driving system including an electric motor 40 as a drive source for the respective rollers will be explained. A driving gear 42 is mounted on a driving shaft of the electric motor 40, and meshes with a gear 44. The gear 44 meshes with gears 46 and 48. A gear 50 integral with the gear 46 meshes with a driven gear 52 of the lower discharge roller **14*a*. A gear 54 integral with the gear 48 meshes with a driven gear 56 of the lower conveying roller 12*a*. A gear 58 rotating integrally with the driven gear 56 meshes with a gear 60. A gear 62 integral with the gear 60 meshes with a driven gear 64 of the paper feed roller 10. A gear 66 (rotating integrally with the paper feed roller 10) to be driven by the driven gear 64 via a one-way clutch (to be described later) meshes with a gear 68. The gear 68 meshes with a driven gear 69 of the forwarding roller 8. Thus, when the driven gear 42 of the electric motor 40 rotates clockwise in FIG. 5, the lower discharge roller 14*a*, the lower conveying roller 12*a*, the paper feed roller 10 and the forwarding roller 8 are rotationally driven counterclockwise in FIG. 5**.

Figure 4:
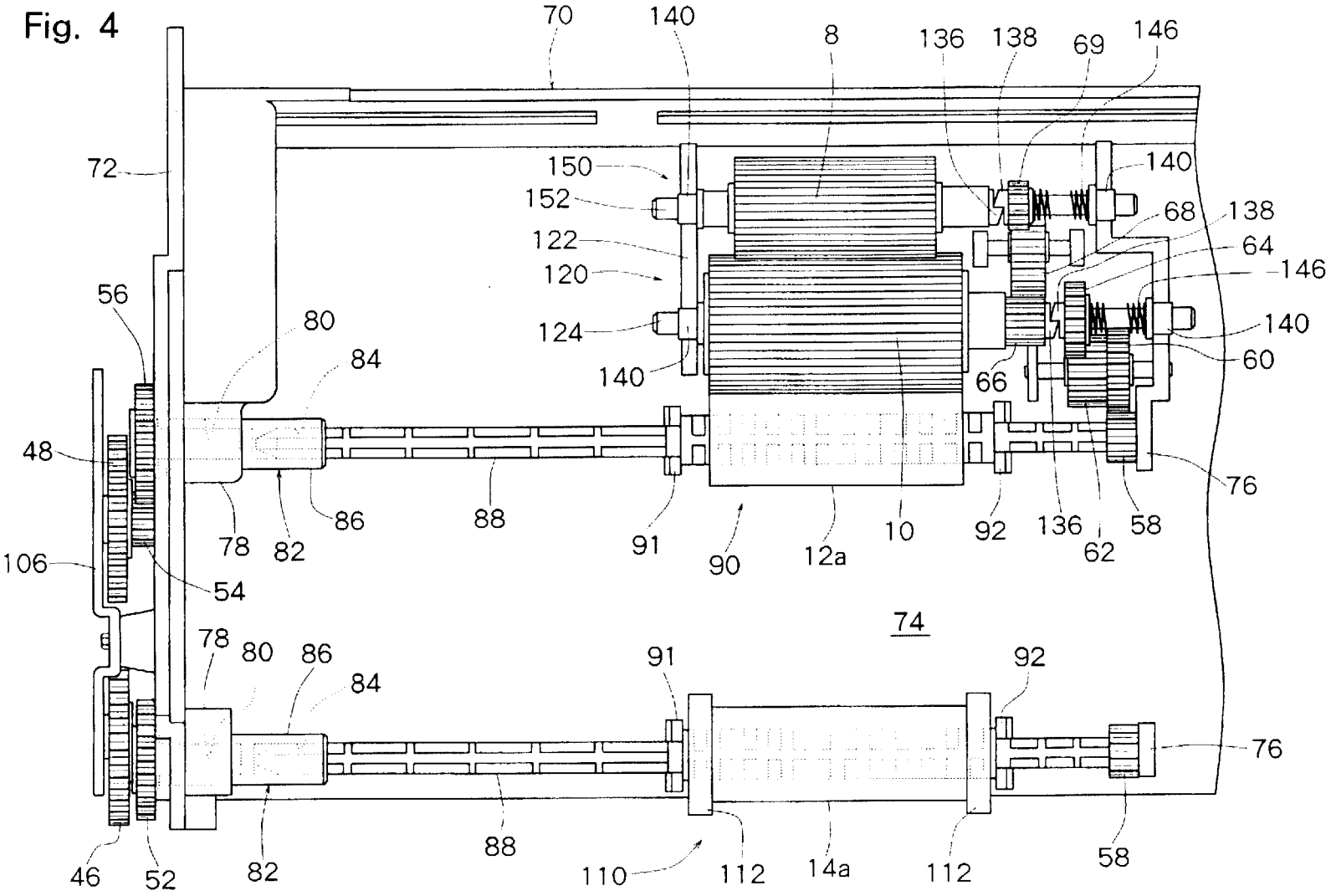
FIG. 4 is a plan view of the mechanism of FIG. 3 with some parts omitted for ease of understanding.

With reference to FIG. 3 and FIG. 4, the numeral 70 denotes a support frame. The support frame 70, partly shown in the drawing, has a pair of side walls 72 (only one of them is shown) arranged with a spacing, and a transverse wall 74 extending between the side walls 72. On the support frame 70 is mounted the lower conveying guide 6 so as to be positioned above the transverse wall 74, and the upper conveying guide 20 is mounted so as to be positioned above the lower conveying guide 6. The support frame 70 is integrally molded from a glass fiber-reinforced plastic material having sufficient rigidity and strength. An example of the glass fiber-reinforced plastic material is the glass fiber-reinforced ABS resin NC100G10 (Japan Synthetic Rubber Co., Ltd.).

Figure 8:
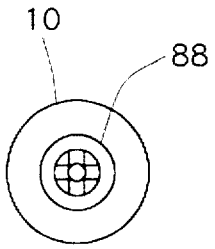
FIG. 8 is a view of the lower conveying roller of FIG. 4 when viewed from the left side.
Figure 9:
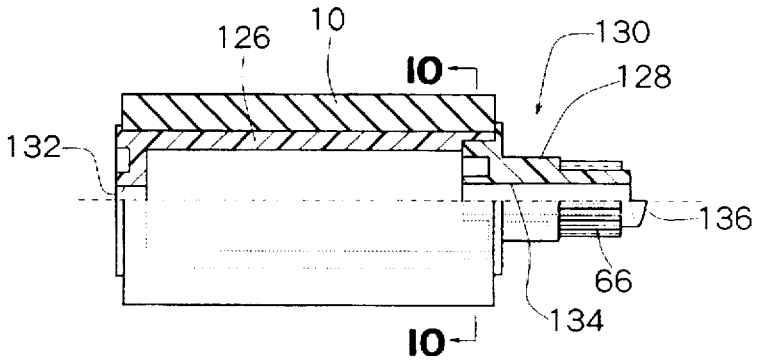
FIG. 9 is a partially sectional plan view of the paper feed roller (and collar means) illustrated in FIG. 4.
Figure 10:
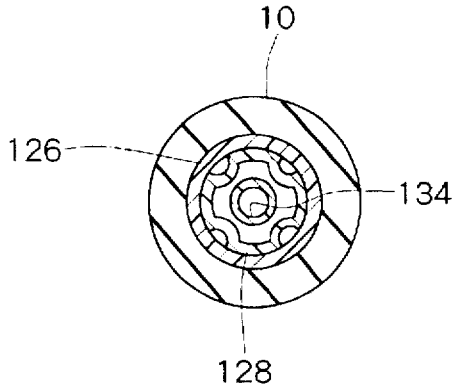
FIG. 10 is a sectional view taken on line 10—10 of FIG. 9.
Figure 11:
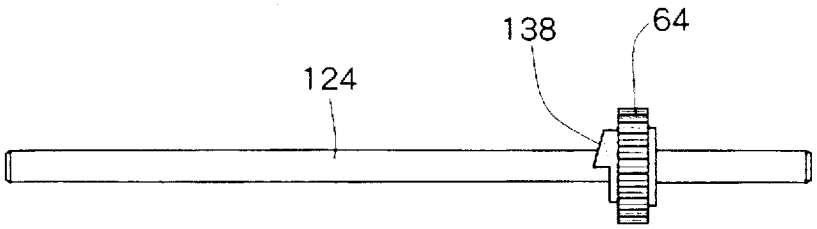
FIG. 11 is a plan view showing the shaft member of the paper feed roller illustrated in FIG. 9.

Next, a roller assembly 90 to be described later will be explained. On the transverse wall 74 is disposed an upright wall 76 which is molded integrally therewith. The upright wall 76 is positioned with a spacing from one of the side walls 72. On the side wall 72 is formed a boss 78, and a support hole 80 is formed in the boss 78. The numeral 82 is an input gear member which has, integrally molded therewith, the driven gear 56 and a journal portion 86 having a connecting hole 84. The input gear member 82 is rotatably supported by the insertion of the journal portion 86 into the support hole 80 of the boss 78. An end part of the shaft member 88 (the left end part in FIG. 4) is releasably inserted into the connecting hole 84 of the journal portion 86, whereby the journal portion 86 and the shaft member 88 are coupled together so as to rotate integrally. On a greater diameter part of the shaft member 88 is mounted the lower conveying roller **12*a* as a roller member so as to be rotatable integrally with the shaft member 88. As shown in FIG. 8, a part having a cruciform cross section is formed at a plurality of sites, including a left end portion, of the shaft member 88. The corresponding site of the connecting hole 84 is also formed to have a cruciform cross section. The input gear member 82, the shaft member 88 and the lower conveying roller 12*a* constitute a roller assembly 90**.

Figure 6:
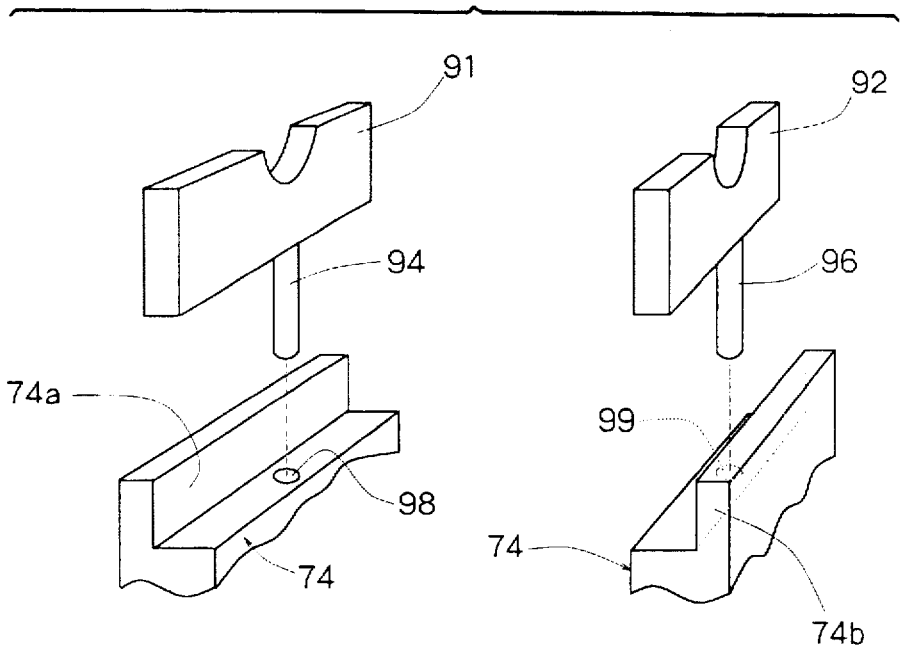
FIG. 6 is a perspective schematic view showing in an exploded manner two bearing pieces for the shaft member of the lower conveying roller illustrated in FIG. 4, and sites where these bearing pieces are mounted.

With reference to FIG. 6 as well, two bearing pieces 91 and 92 each cut open in the upper half thereof and rotatably supporting the shaft member 88 are disposed with a spacing in the axial direction of the shaft member 88 on the transverse wall 74 extending below the roller assembly 90. At the bottoms of the bearing pieces 91 and 92 are integrally molded support rods 94 and 96 extending vertically downwardly. These support rods 94 and 96 are inserted into support holes 98 and 99 formed in the transverse wall 74, whereby the bearing pieces 91 and 92 are mounted on the transverse wall 74. The numerals **74*a* and 74*b* of FIG. 6 are toppling stoppers (upright walls) integrally molded on the transverse wall 74 for preventing toppling of the bearing pieces 91 and 92**.

Figure 7:
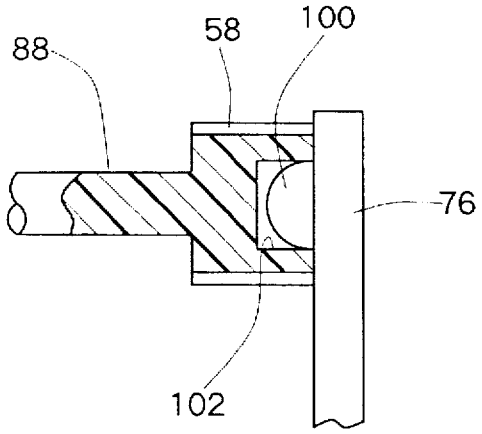
FIG. 7 is a partially sectional side view showing a support structure for a right end portion of the shaft member of the lower conveying roller illustrated in FIG. 4.

With reference to FIG. 7 as well, a support protrusion 100 comprising a hemispherical surface is formed at a site of the upright wall 76 which is opposite to the support hole 80. At the other end (right end) of the shaft member 88 is formed a supported hole 102. The supported hole 102 of the shaft member 88 is releasably and rotatably supported on the support protrusion 100, whereby the second end of the shaft member 88 is rotatably supported on the upright wall 76. At the second end portion of the shaft member 88 is integrally molded the gear 58.

The shaft member 88 is lowered, with its second end being engaged with the support protrusion 100, to be positioned horizontally and supported on the bearing pieces 91 and 92. Then, with the journal portion 86 of the input gear member 82 being inserted into the support hole 80 of the boss 78, the connecting hole 84 and one end portion of the shaft member 88 are fitted together. Thereby the roller assembly 90 can be assembled easily and rotatably supported. The shaft member 88 has the opposite side parts of its larger diameter portion supported by the bearing pieces 91 and 92.

The shaft member 88 is formed of a glass fiber-reinforced plastic material having sufficient rigidity and strength. An example of the glass fiber-reinforced plastic material is the glass fiber-reinforced PPS (polyphenylene sulfide) resin C-200SC (Idemitsu Petrochemical Co., Ltd.). The input gear member 82 is formed of an oleoresinous material having sufficient hardness and strength as well as a low friction coefficient. An example of the oleoresinous material is oleoresinous POM (polyoxymethylene) (trade name: TENAC, model: LA541; a product of Asahi Chemical Industry Co., Ltd.). The bearing pieces 91 and 92 are also formed of oleoresinous POM. The lower conveying roller 12*a* is formed from chloroprene rubber (CR), synthetic rubber.

The numeral 110 denotes another roller assembly including the lower discharge roller 14*a*. The roller assembly 110 is constituted by mounting a sponge 112 on each of the opposite ends of a larger diameter part of a roller assembly of the same type as the shaft member 88 of the roller assembly 90. The other structure and support mechanism are substantially the same as for the roller assembly 90. Thus, the same parts are assigned the same numerals, and an explanation is omitted. The diameter of the sponge 112 is set to be larger than that of the lower discharge roller 14*a*, which is a roller member.

With reference to FIG. 3 to FIG. 5, the electric motor 40 is mounted on a motor support plate 104, and the motor support plate 104 is mounted on a gear support plate 106. On the gear support plate 106 are mounted the gears 44, 46, 48, 50, 52 and 54. The motor support plate 104, gear support plate 106 and gears 44 to 54 constitute a gear unit. The gear support plate 106 is attached to the side wall 72 of the support frame 70 from outside thereof, whereby the gear unit is releasably mounted on the side wall 72. In this state of mounting, the gear 48 is positioned adjacent to an axially outward site of the gear 56 of the input gear member 82 of the roller assembly 90. The gear 46 is likewise positioned adjacent to an axially outward site of the gear 56 of the input gear member 82 of the roller assembly 110. Because of this layout, each input gear member 82 is prevented from slipping off axially, and thus, a special stop member is not required.

As clear from the above description, the roller assemblies 90 and 110, including the support mechanisms for them, have few constituent parts and are easy to assemble, lightweight, and producible at a low cost.

Next, a roller assembly 120, including the paper feed roller 10, will be explained with reference to FIG. 3, FIG. 4, FIG. 9, FIG. 10 and FIG. 11. On the transverse wall 74 of the support frame 70 is integrally molded another upright wall 122. The upright wall 122 is disposed to oppose the upright wall 76 with a spacing. The roller assembly 120 has a shaft member 124 rotatably supported between upright walls 122 and 76, and the paper feed roller 10, a roller member, is rotatably supported on the shaft member 124. The paper feed roller 10, which is formed of synthetic rubber, is mounted on a collar means 130 comprising collars 126 and 128 of a plastic material so as to be rotatable integrally therewith. A through-hole 132 is formed in a central part of a wall formed at one end (left end in FIG. 9) of the collar 126, and collar 128 is press-fitted into the other end of the collar 126. The press-fit part of the collar 128 has a hollow shape with a plurality of axially extending grooves formed at an outer peripheral part thereof to impart an elastic holding force for the collar 126. A through-hole 134 is formed in the collar 128 as well. The through-holes 132 and 134 have a common axis and are formed with the same diameter. At one end portion of the collar 128 are integrally molded the gear 66 and a driven cam 136. The driven cam 136 has an axially extending driven end surface and an inclined surface having an axial length gradually decreasing from the driven end surface over a peripheral range of 180°. The driven cam 136 and the gear 66 rotate integrally with the paper feed roller 10.

On the shaft member 124, of a glass fiber-reinforced plastic material having sufficient strength and rigidity, are integrally molded a driving cam 138 and the driven gear 64 formed of the same material. The driving cam 138 has a driving end surface engaging the driven end surface of the driven cam 136 and an inclined surface formed over a peripheral range of 180° opposing the inclined surface of the driven cam 136. The driving cam 138 and the driven cam 136 constitute a one-way clutch.

Figure 13:
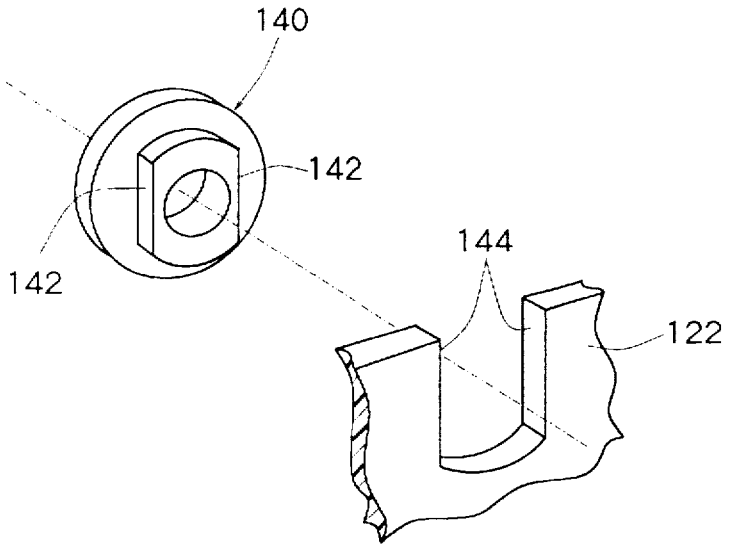
FIG. 13 is a perspective view showing in an exploded manner one of the bearing members for the shaft members of the paper feed roller and forwarding roller illustrated in FIG. 4, and a site where it is mounted.

The paper feed roller 10 is supported on the shaft member 124 via the collar means 130 so as to be rotatable and axially movable. Opposite end portions of the shaft member 124 are rotatably supported on the upright wall 122 and the upright wall 76 via flanged bearing members 140. As shown in FIG. 13, the bearing member 140 has parallel cutouts 142 at opposite positions of its peripheral surface. The upright wall 122 has a cutout 144 having a shape corresponding to the cutouts 142. The cutouts 142 are engaged with the cutout 144, whereby the bearing member 140 is supported so as not to be rotatable. The upright wall 76 has a similar cutout 144.

Between the driven gear 64 and the bearing member 140 supported on the upright wall 76 is mounted a coiled spring 146, which is an urging means. The coiled spring 146 urges the entire shaft member 124 axially leftwards in FIG. 4 to engage the driving cam 138 with the driven cam 136. Because of this layout, a special stop member for each bearing 140 can be omitted, reducing the number of constituent parts and facilitating an assembly operation. The upward withdrawal of the bearing member 140 can be performed easily by forming a suitable pressing member on the undersurface of the upper conveying guide 20.

When the rotational speed of the paper feed roller 10 does not exceed the rotational speed of the driven gear 68, with the driven gear 64 being rotationally driven by the electric motor 40, the driven cam 136 is engaged with the driving cam 138, whereupon the paper feed roller 10 is rotationally driven by the driven gear 64 (the one-way clutch is not in operation). When the rotational speed of the paper feed roller 10 exceeds the rotational speed of the driven gear 64, the engagement of the driven cam 136 with the driving cam 138 is released (the one-way clutch is in operation).

Each of the bearing members 140 is formed of an oleoresinous material. An example of the oleoresinous material is DURACON (trade name) containing molybdenum. An example of a glass fiber-reinforced plastic material constituting the shaft member 124 is glass fiber-reinforced PPS (polyphenylene sulfide) resin of Idemitsu Petrochemical Co., Ltd. (trade name: Idemitsu PPC, model: C-200SC). An example of synthetic rubber making up the paper feed roller 10 is EPDM (ethylene-propylene diene monomer) of Hokushin Industries Inc. (model 157350). An example of a plastic material forming the collars 126 and 128 is non-oleoresinous POM.

As noted above, the roller assembly 120 uses no metallic material. The shaft member 124, the driving cam 136, and the driven gear 64 are integrally molded from a plastic material, and so constituted from one constituent part. Thus, the roller assembly 120 is easy to produce, has fewer constituent parts, and is simple in an assembly operation, lightweight, and low in the cost of production.

Figure 12:
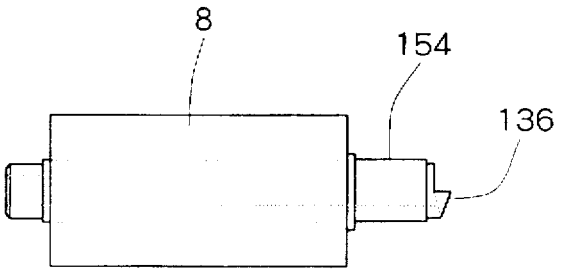
FIG. 12 is a plan view of the forwarding roller (and collar means) shown in FIG. 4.

Next, a roller assembly 150 including the forwarding roller 8 will be explained with reference to FIG. 3, FIG. 4 and FIG. 12. The roller assembly 150 has a shaft member 152 rotatably supported between upright walls 122 and 76, and the forwarding roller 8, a roller member, is rotatably supported on the shaft member 152. The forwarding roller 8, formed of synthetic rubber, is mounted on a collar 154 of a plastic material so as to be rotatable integrally therewith. At an end part of the collar 154 is integrally molded a driven cam 136, like the driver cam 136 on collar 128 of roller assembly 120. On the shaft member 152 are integrally molded a driving cam 138, like the driving cam 138 on shaft member 124 of roller assembly 120, and the driven gear 69 comprised of the same material. The forwarding roller 8 is supported on the shaft member 152 via the collar 154 so as to be rotatable and axially movable. The roller assembly 150 is different from the roller assembly 120 only in the makeup of the collar 154, and the other structure and materials are substantially the same. Therefore, the same parts are assigned the same numerals, and an explanation is omitted. The material of the collar 154 is common to the collars 126 and 128.

According to the sheet member conveying mechanism of the present invention described based on the embodiments, a sheet member with a curled front end portion can be conveyed smoothly and reliably, and a jam can be prevented securely. Moreover, a sheet member conveying mechanism having a roller assembly is obtained which uses fewer constituent parts, is easy to assemble, is lightweight, and can be produced at a low cost. Furthermore, a sheet member conveying mechanism having a roller assembly including a one-way clutch is obtained which is easy to produce, uses fewer constituent parts, is easy to assemble, is lightweight, and has a low cost.

What we claim is:

1. A sheet member conveying mechanism comprising a conveying guide for guiding a sheet member from a paper feed port to a paper discharge tray; a forwarding roller disposed on the most upstream side of the conveying guide with an upper part of the outer peripheral surface of the forwarding roller exposed upwards from the upper surface of the conveying guide over a predetermined peripheral range, to permit the forward end portion of the sheet member to curl downwardly over the forwarding roller; and a paper feed roller disposed on the downstream side of the forwarding roller with an upper part of the outer peripheral surface of the paper feed roller exposed upwards from the upper surface of the conveying guide over a predetermined peripheral range, whereby sheet members sent forward by the forwarding roller, are conveyed downstream one by one; the axes of the forwarding roller and the paper feed roller being located parallel to each other, and the uppermost site of the paper feed roller being located lower than the upper site of the forwarding roller; wherein, the upper surface of the conveying guide is curved with a downwardly protruding shape and with its height decreasing beginning at the downstream end of the exposed part of the outer peripheral surface of the forwarding roller toward the upstream end of the exposed part of the outer peripheral surface of the paper feed roller, as viewed in the roller axial direction, so that a sheet member having its forward end portion curled downwardly over the forwarding roller avoids contact with the upper surface of the conveying guide.

2. The sheet conveying mechanism of claim 1, wherein as viewed in the axial direction, the upper surface of the conveying guide has no upwardly displaced part between the downstream end of the exposed upper part of the outer peripheral surface of the forwarding roller and the upstream end of the exposed upper part of the upper peripheral surface of the paper feed roller, and $$12\ \text{mm} > R > 8\ \text{mm}$$

$$80° > \theta > 60° \text{ and}$$

$$10\ \text{mm} > h > 6\ \text{mm},$$

where

R is the radius of the forwarding roller,

θ is the peripheral angle between the uppermost side of the outer peripheral surface of the forwarding roller and the downstream end of the exposed upper part of the outer peripheral surface of the forwarding roller, as viewed in the axial direction, and h is the vertical distance from the uppermost site of the forwarding roller to the uppermost site of the paper feed roller.

3. A sheet member conveying mechanism comprising:

an integrally molded support frame including a transverse wall, a pair of spaced apart bearing pieces, each being cut open in the upper half thereof, and a pair of spaced apart upright walls, one of the upright walls having a support hole therein;

a roller assembly rotatably supported by the bearing pieces between the upright walls and over the transverse wall, the roller assembly including a shaft member of a plastic material, a roller member of synthetic rubber mounted on the shaft member, and an input gear member of a plastic material and having an integrally molded journal portion with a connecting hole, the journal portion being releasably and rotatably supported in the upright wall support hole, and the shaft member having one end releasably inserted into the connecting hole of the input gear member to couple the shaft member and the input gear member together so as to rotate integrally.

4. The sheet member conveying mechanism of claim 3, wherein a hemispherical support protrusion is provided on the other of the upright walls at a site opposite to the support hole of the one of the upright walls, a supported hole is formed at the other end of the shaft member, and the supported hole of the shaft member is releasably and rotatably supported on the support protrusion.

5. The sheet member conveying mechanism of claim 3, further comprising a support frame having each of the upright walls integrally molded therewith, the support frame being formed of a glass fiber-reinforced plastic material.

6. The sheet member conveying mechanism of claim 3, wherein the shaft member is formed of a glass fiber-reinforced plastic material.

7. The sheet member conveying mechanism of claim 3, wherein the input gear member is formed of an oleoresinous material.

8. The sheet member conveying mechanism of claim 3, further comprising a conveying guide for guiding a sheet member from a paper feed port to a paper discharge tray, a forwarding roller disposed on the most upstream side of the conveying guide, a paper feed roller disposed on the downstream side of the forwarding roller to convey sheet members, forwarded by the forwarding roller, downstream one by one, a conveying roller pair disposed on the downstream side of the paper feed roller, and a discharge roller pair disposed on the downstream side of the conveying roller pair; the conveying roller pair including a lower conveying roller and an upper conveying roller, and the discharge roller pair including a lower discharge roller and an upper discharge roller; wherein the roller member of the roller assembly comprises at least one of the lower conveying roller and the lower discharge roller.

9. A sheet member conveying mechanism comprising a first roller assembly having a relatively high peripheral speed, a second roller assembly disposed upstream of the first roller assembly and having a relatively low peripheral speed, and a pair of spaced apart upright walls, wherein the second roller assembly includes a shaft member rotatably supported between the upright walls, and a roller member rotatably supported on the shaft member; a one-way clutch including a driving cam and a driven cam and provided between the shaft member and the roller member; the driven cam being connected with the roller member so that the driven cam and the roller member rotate integrally; the driving cam and a driven gear being connected with the shaft member, the driven gear drivingly coupling the shaft member to a drive source so that the driving cam and the driven gear rotate integrally with the shaft member, and an urging means on the shaft member to urge the driving cam axially into engagement with the driven cam; so that with the driven gear being rotationally driven by the drive source, when the rotational speed of the roller member does not exceed the rotational speed of the driven gear, the driven cam is engaged with the driving cam, whereby the roller member is rotationally driven by the driven gear, and when the rotational speed of the roller member exceeds the rotational speed of the driven gear, the driven cam is disengaged from the driving cam; wherein the shaft member is rotatably and axially movably supported via bearing members of a plastic material between the upright walls, the roller member is formed of synthetic rubber, and is mounted on a collar means rotatably supported on the shaft member so as to be rotatable integrally with the collar means, the collar means and the driven cam being integrally molded from a plastic material, and the shaft member, the driving cam and the driven gear are integrally molded from a plastic material.

10. The sheet member conveying mechanism of claim 9, wherein the shaft member, the driving cam, and the driven gear are integrally molded from a glass fiber-reinforced plastic material.

11. The sheet member conveying mechanism of claim 9, wherein each of the bearing members is formed of an oleoresinous material.

12. The sheet member conveying mechanism of claim 9, further comprising a conveying guide for guiding a sheet member from a paper feed port to a paper discharge tray, a forwarding roller disposed on the most upstream side of the conveying guide, a paper feed roller disposed on the downstream side of the forwarding roller to convey sheet members, forwarded by the forwarding roller, downstream one by one, a conveying roller pair disposed on the downstream side of the paper feed roller, and a discharge roller pair disposed on the downstream side of the conveying roller pair, wherein the peripheral speed of the conveying roller pair is set to be higher than the peripheral speed of the paper feed roller, and the peripheral speed of the paper feed roller is set to be higher than the peripheral speed of the forwarding roller, and the roller member of the second roller assembly comprises at least one of the paper feed roller and the forwarding roller.

13. A sheet member conveying mechanism comprising:

a conveying guide for guiding a sheet member from a paper feed port to a paper discharge tray, the conveying guide including a pair of spaced apart upright walls, one of the upright walls having a support hole therein;

a forwarding roller disposed on the most upstream side of the conveying guide;

a paper feed roller disposed on the downstream side of the forwarding roller to feed sheet members, forwarded by the forwarding roller, downstream one by one;

a conveying roller pair disposed on the downstream side of the paper feed roller; and a discharge roller pair disposed on the downstream side of the conveying roller pair; wherein:

the conveying roller pair includes a lower conveying roller and an upper conveying roller, and the discharge roller pair includes a lower discharge roller and an upper discharge roller;

at least one of the lower conveying roller and the lower discharge roller includes a shaft member of a plastic material, a roller member of synthetic rubber mounted on the shaft member, and an input gear member of a plastic material and having an integrally molded journal portion with a connecting hole, the journal portion being releaseably and rotatably supported in the upright wall support hole; and one end portion of the shaft member is releasably inserted into the connecting hole of the input gear member to couple the shaft member and the gear member together so as to rotate integrally.

14. A sheet member conveying mechanism comprising:

a support frame including a transverse wall, a pair of spaced apart bearing pieces, each being open in the upper half thereof, and a pair of spaced apart upright walls, one of the upright walls having a support hole therein;

a roller assembly rotatably supported by the bearing pieces between the upright walls and over the transverse wall, the roller assembly including a shaft member, a roller member mounted on the shaft member, and an input gear member having a journal portion with a connecting hole, the journal portion being releasably and rotatably supported in the upright wall support hole, and the shaft member having an end portion releasably inserted into the connecting hole of the input gear member to couple the shaft member and the input gear member together so as to rotate integrally.

15. A sheet member conveying mechanism comprising:

a conveying guide for guiding a sheet member from a paper feed port to a paper discharge tray, the conveying guide including a pair of spaced apart upright walls, one of the upright walls having a support hole therein;

a forwarding roller disposed on the most upstream side of the conveying guide;

a paper feed roller disposed on the downstream side of the forwarding roller to feed sheet members, forwarded by the forwarding roller, downstream one by one;

a conveying roller pair disposed on the downstream side of the paper feed roller; and a discharge roller pair disposed on the downstream side of the conveying roller pair; wherein:

the conveying roller pair includes a lower conveying roller and an upper conveying roller, and the discharge roller pair includes a lower discharge roller and an upper discharge roller;

at least one of the lower conveying roller and the lower discharge roller includes a shaft member, a roller member mounted on the shaft member, and an input gear member and having a journal portion with a connecting hole, the journal portion being releaseably and rotatably supported in the upright wall support hole; and one end portion of the shaft member is releasably inserted in to the connecting hole of the input gear member to couple the shaft member and the gear member together so as to rotate integrally.

* * * * *